United States Patent [19]

Wich

[11] 3,971,278

[45] July 27, 1976

[54] CARRIAGE POSITIONING MECHANISM

[76] Inventor: Horst W. Wich, 816 Brent St., South Pasadena, Calif. 91030

[22] Filed: June 30, 1975

[21] Appl. No.: 591,639

Related U.S. Application Data

[62] Division of Ser. No. 458,708, April 8, 1974.

[52] U.S. Cl. ..... 83/413; 83/556; 83/560; 83/917

[51] Int. Cl.[2] ..... B26F 1/12

[58] Field of Search ..... 83/409, 413, 556, 560, 83/917

[56] References Cited

UNITED STATES PATENTS 1,615,020 1/1927 Loehr et al. ..... 83/560 X 1,764,828 6/1930 Cotton ..... 83/560 X

*Primary Examiner*—J. M. Meister

[57] ABSTRACT

A carriage positioning mechanism including a carriage, a guideway along which the carriage is movable through a sequence of predetermined positions, a coarse position adjustment means for advancing the carriage from one position to the next, and a fine position adjustment means which is operable only after a coarse position of the carriage has been established. The coarse positioning means includes a notched rack and a ratchet cooperable therewith. The fine positioning means includes a separate locating hole associated with each notch of the rack.

11 Claims, 12 Drawing Figures

CARRIAGE POSITIONING MECHANISM

RELATED APPLICATION

This application is a division of my prior copending application Ser. No. 458,708, filed Apr. 8, 1974.

SUMMARY OF THE INVENTION

According to one feature of the invention a movable carriage is provided with two separate positioning mechanisms, one being operable for establishing a coarse position of the carriage and the other being subsequently operable for establishing a fine or precise position of the carriage.

According to another feature of the invention the fine positioning mechanism cannot become operable until a coarse position of the carriage has been established.

A notched rack and a cooperating ratchet are utilized for establishing the coarse position of the carriage. A separate locating hole is formed in the notched rack associated with each notch. A tapered locating pin cooperates with the corresponding locating hole to achieve the fine positioning of the carriage. The locating pin is reciprocable in a direction perpendicular to the direction of carriage movement. The notched rack is attached to one of the carriage and guideway, while the ratchet and locating pin are supported from the other. The locating pin cannot enter any of the locating holes unless the carriage, approximately or in a coarse sense, occupies one of its predetermined positions. Then the pin can enter only the locating hole corresponding to that carriage position, and in doing so achieves a precise positioning action.

In the preferred form of the invention a drive spring is utilized for advancing the carriage from one position to the next.

The invention is illustrated in its application to the movable die carriage of a key cutting machine.

Thus the object and purpose of the invention is to provide a carriage positioning mechanism which is highly precise and essentially automatic in its operation.

DRAWING SUMMARY

PREFERRED EMBODIMENT

Figure 12:
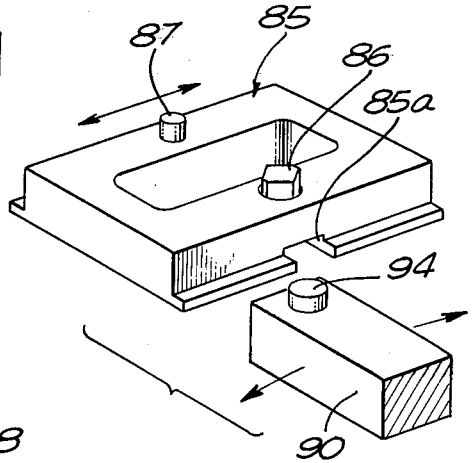
FIG. 12 is a perspective view of the depth cam carriage.

Reference is now made to the drawings and to FIGS. 1 through 10, inclusive, and 12 illustrating the presently preferred form of the invention.

The machine has an elongated base 10 and an elongated operating handle 20 which is disposed above the base in a generally parallel relationship thereto. The rearward end 21 of the operating handle is pivotally supported above the rearward end of the base upon a pivot shaft 23. The forward end 22 of the operating handle is disposed above the forward end of the base. Forward end 22 of the operating handle is normally somewhat elevated, and is held in that position by means of a pair of return springs 24 which couple the rearward extremity of the handle (to the rear of pivot shaft 23) to the rearward end of the base.

In general, the method of cutting a key is to first position a key blank in the machine according to a particular notch that is to be cut in the blank, and then the forward end 22 of the operating handle 20 is manually depressed in order to cause the desired notch to be cut in the key blank by means of a punch and die mechanism. Furthermore, as will be described, a feature of the invention is that the release of the operating handle, and its subsequent upward movement, causes a ratchet mechanism associated with the die carriage to be released so that the die carriage may be automatically advanced in a direction longitudinally of the key blank to the next notch location.

Figure 2:
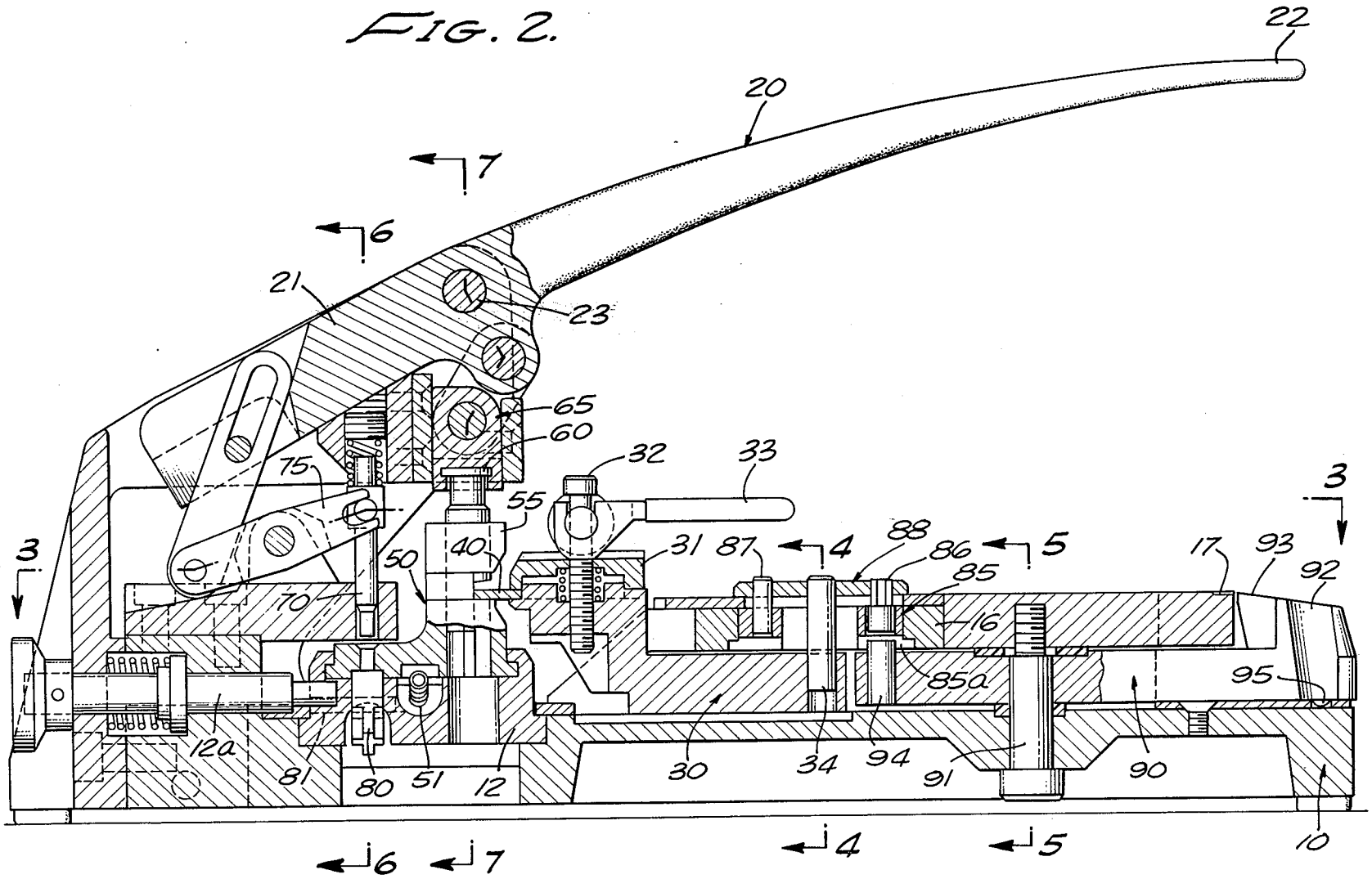
FIG. 2 is an elevational cross-sectional view of the machine taken on the line 2—2 of FIG. 1.

Thus there is provided on the base 10 a track 12 which extends transversely of the machine, and supports a die carriage 50 in sliding relationship therewith so that the die carriage may reciprocate in a horizontal plane but transversely to the longitudinal axes of base 10 and operating handle 20. Track 12 is positioned directly below the pivot shaft 23, as best seen in FIG. 2.

Figure 4:
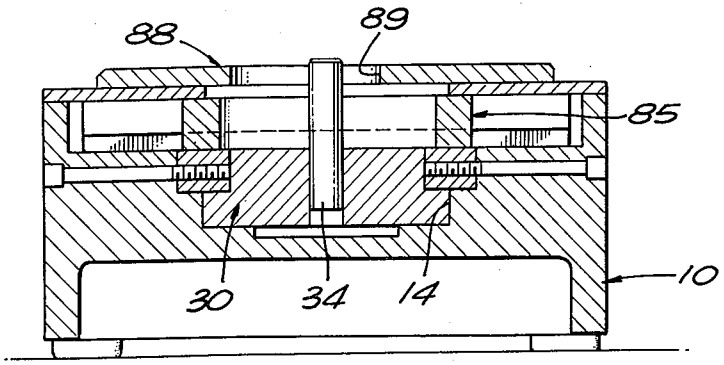
FIG. 4 is a transverse cross-sectional view taken on the line 4—4 of FIG. 2.

Also provided on the base 10 is a track 14 for supporting a key carriage 30. Key carriage 30 supports a key blank 40 (FIGS. 1, 2, and 9), and the key blank is disposed in a horizontal plane with its longitudinal axis extending transversely of the machine. Key carriage 30 is disposed forwardly of the die carriage 50. Key carriage 30 is also adapted for reciprocating movement in a horizontal plane, but this movement takes place lengthwise of the machine, so that the key blank 40 is moved either closer to or further away from the die carriage 50. Key carriage track 14 extends longitudinally of the machine (FIG. 4).

Figure 6:
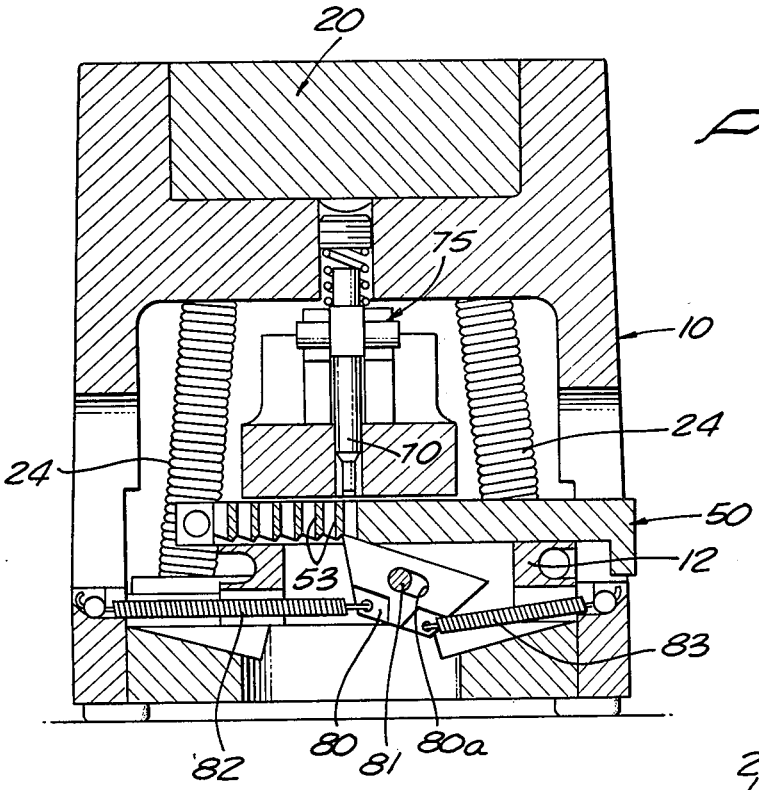
FIG. 6 is a transverse cross-sectional view taken on the line 6—6 of FIG. 2.
Figure 7:
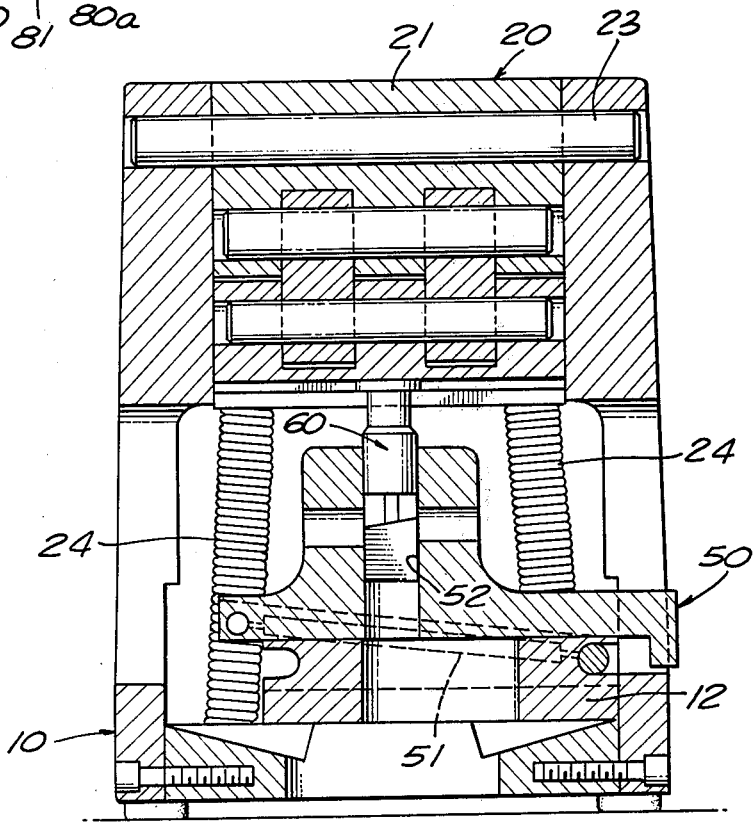
FIG. 7 is a transverse cross-sectional view taken on line 7—7 of FIG. 2.
Figure 8:
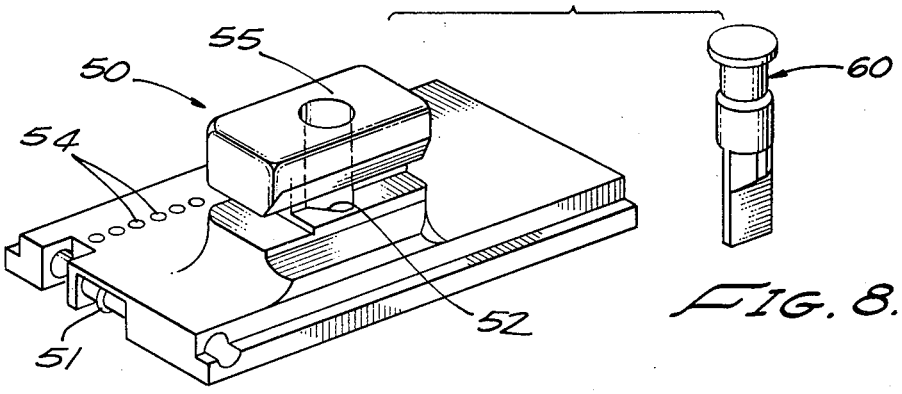
FIG. 8 is a perspective view of the die carriage and of the punch associated therewith.
Figure 9:
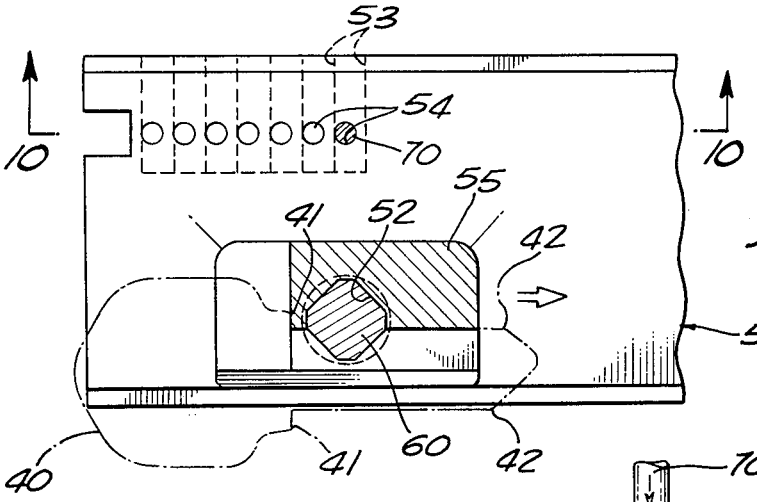
FIG. 9 is a top plan view of the die carriage partially in cross-section.

Die carriage 50 may move either from left to right or from right to left in its tract 12 depending upon whether the key blank is to be cut commencing from its shoulder 41 or from its tip end 42. Tract 12 (FIGS. 2 and 6) has two alternate positions, one at the left of the machine and one at the right of the machine, and a spring-loaded lock pin 12*a* (FIG. 2) is utilized to lock the track in its selected position. If the key blank is to be cut from left to right then the track 12 is placed in its right hand position as shown in FIG. 6. If the key blank is to be cut from right to left than the track is placed in its left hand position (not specifically shown).

The die carriage 50 includes a die 52 which is of suitable shape for the particular type of standard key that is to be cut. A punch 60 has a cutting end which is of the same shape. Die carriage 50 includes a raised portion 55 which serves as a vertical guideway for the punch 60, so that the punch 60 is reciprocable in a vertical direction relative to the die 52. Directly below the pivot shaft 23 and operated by downward movement of the operating handle 20 there is a punch drive mechanism 65 which serves to drive the punch 60 downward into and through the die 52.

Also associated with the die carriage 50 is a drive spring 51 (FIGS. 2 and 7) which pulls the die carriage 50 in the desired direction as the cutting of the successive notches on the key blank progresses. The structure of the die carriage 50 is illustrated in detail in FIGS. 6 through 10, inclusive. The undersurface of the die carriage is provided with a series of notches or ratchet grooves 53. These notches are utilized in conjunction with a ratchet mechanism, now to be described, for controlling the automatic advance action of the die carriage.

Figure 10:
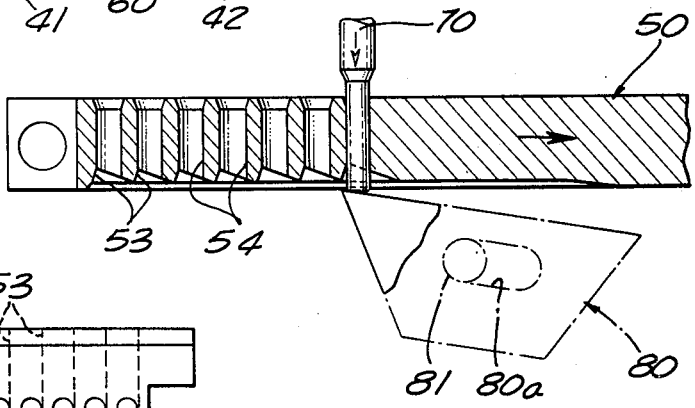
FIG. 10 is a longitudinal cross-sectional view of the die carriage taken on the line 10—10 of FIG. 9.

The ratchet mechanism includes a ratchet plate 80, FIGS. 6 and 10, which has a trapezoidal configuration. Ratchet plate 80 is disposed in a vertical plane extending transversely of the machine. The long side of the trapezoid is disposed upward while the short side is disposed downward. Ratchet plate 80 also has a horizontally elongated central opening 80*a*. A ratchet pin 81 is an integral part of the die carriage track 12, and extends through the central opening 80*a*. A pair of identical springs 82 and 83 are fastened to the lower corners of the ratchet plate 80, and each of these springs has its remaining end secured to the corresponding lateral edge of the base 10 as shown in FIG. 6. The positioning of track 12 at either the extreme left or the extreme right of the machine base, however, has the effect of causing one of the springs to be relatively short while the other is relatively long. Thus as shown in FIG. 6 the spring 82 on the left side of the machine is relatively long while spring 83 on the right side of the machine is relatively short.

The ratchet mechanism operates as follows. The relatively long spring pulls the associated upper end of the ratchet plate 80 upward, as shown in FIG. 6. The raised corner of the ratchet plate therefore engages a notch 53 on the undersurface of die carriage 50. When the ratchet plate is depressed the drive spring 51 causes die carriage 50 to advance, and the ratchet plate then pops upward to engage the next succeeding one of the notches 53, thus stopping the die carriage at the next succeeding notch position for the key blank.

According to my invention a separate mechanism is provided for precisely locating each of the notch positions where a cut is to be made. Thus the die carriage 50 has a series of locator holes 54, each of which is associated with, and communicates with, a corresponding one of the notches 53. Each locator hole 54 extends vertically through the die carriage 50, and each has a conical enlargement in its upper end portion. A locator pin 70 (FIGS. 2, 6, and 10) is supported from the operating handle 20 somewhat to the rear of the punch drive mechanism 65. A locator pin drive mechanism 75 (FIG. 2) couples operating handle to the locator pin 70. This drive mechanism is so designed as to move the locator pin 70 in a downward direction far more rapidly than the punch 60 is moved. Consequently, the locator pin 70 engages one of the locator holes 54, and thus precisely positions the die carriage 50, prior to the engagement of punch 60 with the material of the key blank 40 supported upon the die 52.

Locator pin 70 is not only utilized to achieve a precise position of the die carriage and hence of the longitudinal position of the notch on the key blank, but it also provides an essential portion of the automatic operation of the advance mechanism and its associated ratchet mechanism. Specifically, as the locator pin 70 progresses downward through a locator hole 54 its lowermost end strikes the upper corner of the ratchet plate 80, causing the ratchet plate 80 to lose its engagement with the associated notch 53. This action is illustrated in FIG. 10 of the drawings. Thus as operating handle 20 is released by the operator and is caused to return upward to its normal position by the return springs 24, the upper corner of ratchet plate 80 becomes engaged with the next succeeding one of the notches 53 before the locator pin 70 is fully withdrawn from its engagement with the ratchet plate. Drive spring 51, therefore, advances die carriage 50 to the next notch location.

Key carriage 30 includes a clamp 31 for holding key blank 40 in place. A clamp handle 33 rotates on a clamp bolt 32 for depressing the key clamp 31 against the key blank. Thus the key blank is held securely in place while the machine performs its cutting action, and then the handle 33 is manually rotated upward so as to release the newly cut key from the key carriage.

Also forming a part of key carriage 30 is a drive pin 34 (FIG. 2) which is utilized for adjusting the position of the key carriage in a direction longitudinally of the machine, so as to thereby adjust the depth of each notch that is cut by the punch 60. Drive pin 34, and hence key carriage 30 and key blank 40, is caused to move either towards or away from the die carriage 50, by means of a depth setting mechanism now to be described.

Figure 3:
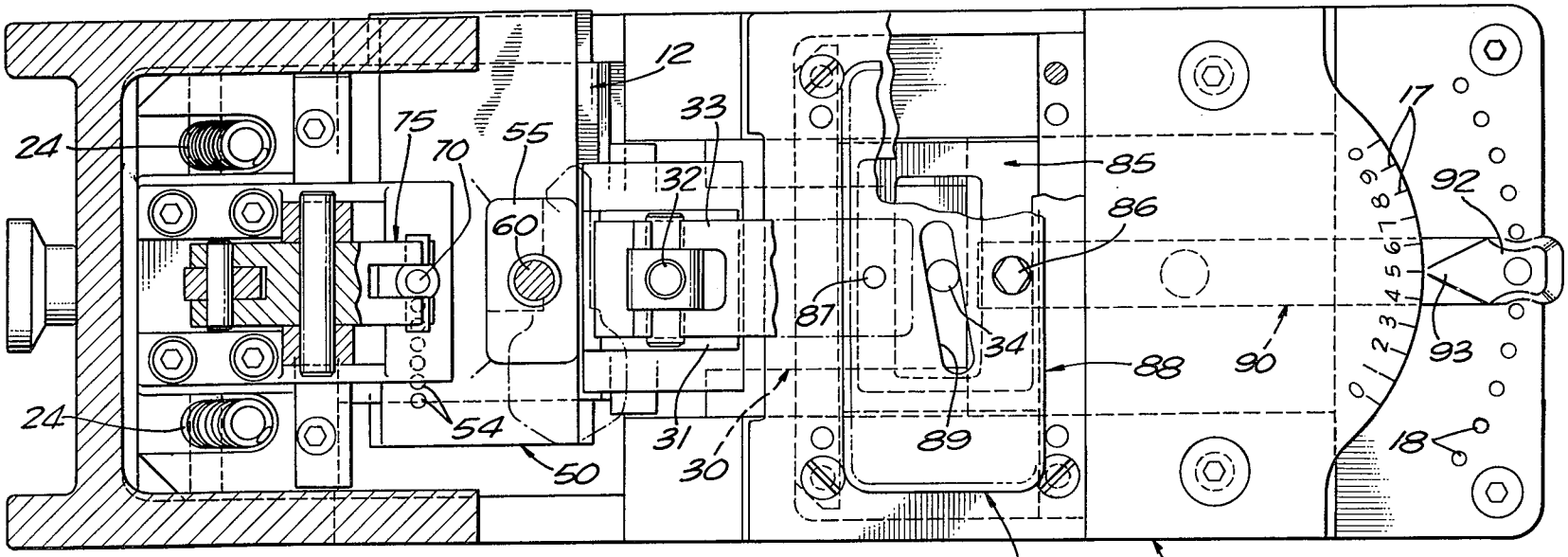
FIG. 3 is a plan view partially in cross-section, taken on line 3—3 of FIG. 2.
Figure 5:
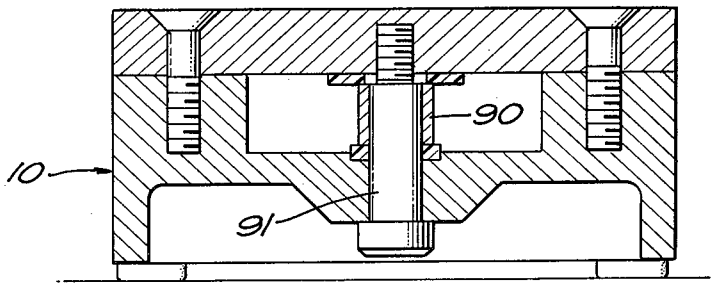
FIG. 5 is a transverse cross-sectional view taken on the line 5—5 of FIG. 2.

Machine base 10 also includes a track 16 for a cam carriage 85. Track 16 (FIG. 2) permits the cam carriage 85 (FIG. 12) to move laterally of the machine base 10. Cam carriage 85 has a forward cam lock pin 86 and a rearward cam lock pin 87. A cam plate 88 (FIGS. 1 and 2) is placed upon the cam carriage and held in position there by means of the lock pins. Cam plate 88 has a cam slot 89 which is best seen in FIG. 3.

Figure 1:
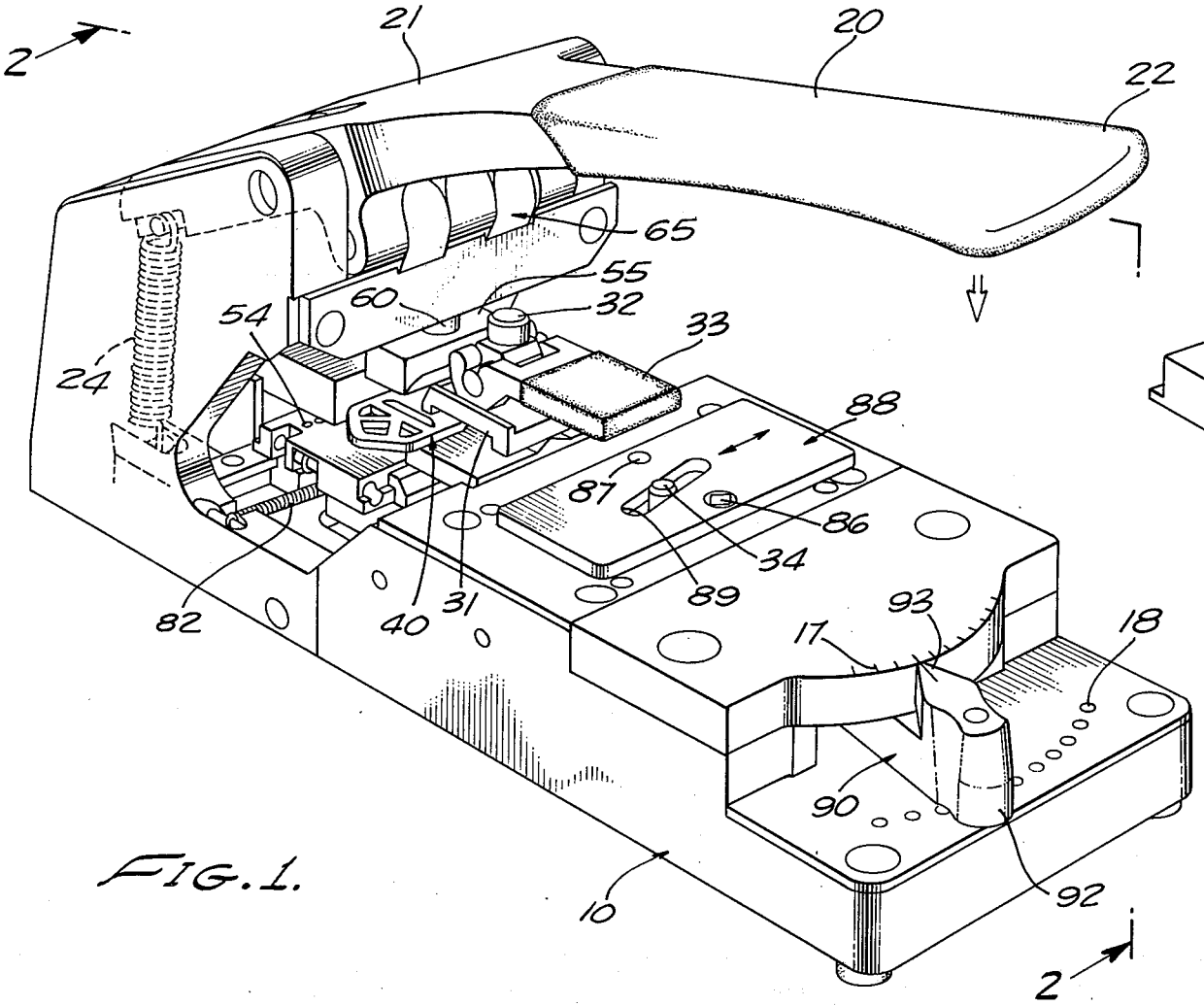
FIG. 1 is a perspective view of my new key cutting machine.

A depth control lever 90 extends longitudinally of the base 10 and is disposed in a horizontal recess in the forward end of the base. A pivot pin 91 extends vertically upward through the base 10 (FIG. 2) and through a corresponding opening in the depth lever 90, to provide a vertical axis about which the depth lever rotates. At its forward end the depth lever 90 has an upwardly projecting drive pin 94 which engages a longitudinal slot 85*a* in the cam carriage 85 (FIG. 1). Pivoting action of the depth lever 90 about the vertical axis of pin 91 produces transverse movement of the cam carriage 85, and drive pin 34 of the key carriage 30 which is received in the cam slot 89 then produces a corresponding longitudinal movement of the key carriage.

At its rearward end the depth lever 90 has a handle 92 above which there is a pointer 93. An arcuate scale 17 formed on the upwardly facing surface of base 10 cooperates with pointer 93 to indicate the depth setting of the key carriage 30. At the same time a spring loaded ball 95 provided on the underside of handle 92 (FIG. 2) cooperates with a corresponding series of dimples or indexing holes 18 in order to lock the depth lever 90 in its selected position.

ALTERNATE FORMS

Figure 11:
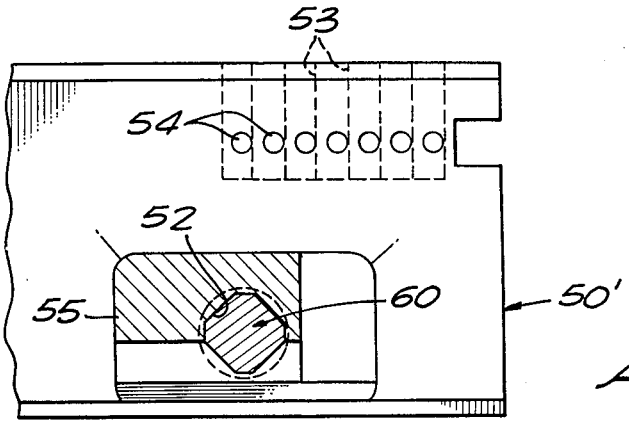
FIG. 11 is a plan view of an alternate form of the die carriage.

FIG. 11 illustrates an alternate form of die carriage 50′ which has its locating holes and ratchet notches on the other end, and is hence designed to move in the opposite direction and cooperate with ratchet plate 80 when having its right hand end held in a raised position.

While in the presently illustrated embodiment of the invention the notched rack is incorporated as a part of the carriage, it will be appreciated that a separate notched rack could be utilized if desired. Furthermore, the mechanism as presently illustrated can be reversed, if so desired, with the notched rack being supported from the guideway or frame and the ratchet and locating pin being supported from the moveable carriage.

While a particular embodiment of the invention has been described in complete detail in order to comply with the disclosure requirements of the patent laws, it will nevertheless be understood that the breadth and scope of the invention are to be limited only in accordance with the following claims:

What is claimed is:

1. In a key cutting machine, punch and die mechanism comprising:

a die carriage having a die and a punch supported thereon, said punch being reciprocable within said die;

guideway means supporting said die carriage for movement in a direction perpendicular to the axis of reciprocation of said punch, said die carriage having a series of notches spaced along one surface thereof in a direction parallel to said guideway means;

ratchet means adapted to engage a selected one of said notches for supporting said carriage in a corresponding position of movement; and drive spring means associated with said die carriage for advancing same through a series of positions corresponding to respective ones of said carriage notches.

2. Key cutting apparatus as claimed in claim 1 wherein said die carriage has a plurality of locator holes formed therein, one associated with each of said die carriage notches;

and which further includes a locating pin and means supporting said locating pin for reciprocation along an axis perpendicular to said guideway means;

each of said locator holes having a tapered open end, and the end of said locating pin being also tapered, whereby the driving insertion of said locating pin into one of said locator holes serves to position said die carriage more precisely than it is initially positioned by said ratchet means acting in cooperation with one of said notches.

3. In a precision machine having a movable carriage adapted for movement through a series of predetermined positions, the combination comprising:

guideway means supporting said carriage for movement thereon;

said carriage having a series of notches spaced along one surface thereof in a direction parallel to said guideway means;

drive spring means associated with said carriage for advancing same along said guideway means;

ratchet means supported from said guideway means and adapted to engage a selected one of said notches for restraining said carriage in a selected one of said predetermined positions;

said carriage also having a plurality of locator holes formed therein, one associated with each of said notches, each of said locator holes having an enlarged and internally tapered end opening;

a locating pin having a tapered end adapted to be loosely received within the tapered end opening of one of said locator holes, the body of said locating pin being adapted to be tightly received within the body of the locator hole in order to perform a centering function therein; and means mounting said locator pin for reciprocation along an axis perpendicular to said guideway means, whereby said carriage is first approximately positioned by said ratchet means and thereafter is more precisely positioned by driving said locating pin into the corresponding locator hole.

4. In a key cutting machine having a traveling die carriage, a punch reciprocable within said die carriage, and means for selectively driving said punch, the improvement comprising:

guideway means having associated drive spring means for advancing said die carriage therealong;

notch and ratchet means for restraining said carriage in a selected position of advancement;

a locating pin adapted to be reciprocably driven along a fixed axis perpendicular to said guideway means; and said die carriage having a plurality of locator holes formed therein, one corresponding to each notch of said notch and ratchet means;

whereby said carriage may first be approximately positioned by said notch and ratchet means, and may then be more precisely positioned by drivably inserting said locating pin into the corresponding locator hole.

5. Key cutting apparatus as in claim 4 which further includes co-acting means for synchronizing the movement of said punch with the movement of said locating pin, and operable for fully inserting said locating pin into the corresponding locator hole before said punch engages said die.

6. Key cutting apparatus as in claim 5 which further includes means cooperating with said locating pin and operable in response to the withdrawal of said locating pin from a corresponding locator hole to advance said notch and ratchet mechanism by one step, whereby said carriage automatically advances to its next position.

7. A carriage positioning mechanism comprising:

a carriage;

a guideway along which the carriage is movable through a sequence of predetermined positions;

a drive spring coupled between said carriage and said guideway for advancing said carriage from one position to the next;

a notched rack supported by one of said carriage and guideway, and a cooperating ratchet supported by the other thereof, for providing a coarse adjustment of the carriage position;

said notched rack having a plurality of locating holes therein associated with corresponding ones of said notches; and a locating pin reciprocably mounted on the same one of said carriage and guideway as supports said ratchet, said locating pin being aligned perpendicular to said notched rack and adapted to enter the particular locating hole corresponding to the presently existing carriage position;

said locating pin and said locator holes having a tapered fitting relationship such that the insertion of said locating pin into one of said locator holes establishes a precise carriage position.

8. The apparatus of claim 7 wherein said notched rack is supported from said carriage and said ratchet and locating pin are supported from said guideway.

9. The apparatus of claim 7 wherein said notched rack is formed integral with said carriage.

10. The apparatus of claim 7 wherein said locating pin when fully inserted into the corresponding locator hole also engages said ratchet, pushing said ratchet out of engagement with the associated notch, so that when said locating pin is later withdrawn the carriage will then automatically advance to its next position.

11. The apparatus of claim 9 wherein said locating pin when fully inserted into the corresponding locator hole also engages said ratchet, pushing said ratchet out of engagement with the associated notch, so that when said locating pin is later withdrawn the carriage will then automatically advance to its next position.

* * * * *